United States Patent [19]

Rivinius

[11] Patent Number: 4,541,584

[45] Date of Patent: Sep. 17, 1985

[54] CABLE WINDING APPARATUS

[76] Inventor: Theodore Rivinius, 810 N. 2nd St., #9, Bismarck, N. Dak. 58501

[21] Appl. No.: 689,824

[22] Filed: Jan. 9, 1985

Related U.S. Application Data

[63] Continuation-in-part of Ser. No. 516,803, Jul. 25, 1983, Pat. No. 4,493,463.

[51] Int. Cl.[4] ..... B65H 54/28

[52] U.S. Cl. ..... 242/158 R; 242/157.1; 242/158 B; 242/158 F

[58] Field of Search ..... 242/158 R, 158 F, 158 B, 242/158.4 R, 157.1, 25 R

[56] References Cited

U.S. PATENT DOCUMENTS

| | | | |
|---|---|---|---|
| 601,827 | 4/1898 | Dahlberg | 242/86.61 |
| 708,979 | 9/1902 | Heylman | 242/86.61 |
| 1,000,203 | 8/1911 | Shannon | 242/86.8 |
| 1,763,871 | 6/1930 | Taylor | 242/157.1 |
| 1,935,585 | 11/1933 | Tornblom | 242/158 B |
| 2,340,436 | 2/1944 | Stone et al. | 242/158 B |
| 2,626,765 | 1/1953 | Biddison | 242/158 F X |
| 2,660,382 | 11/1953 | Wilson | 242/158 R |
| 2,962,242 | 11/1960 | Adams et al. | 242/158.4 |
| 3,397,850 | 8/1968 | Anderson | 242/158 B |
| 3,416,748 | 12/1968 | Bliss | 242/158 B |
| 3,520,494 | 7/1970 | Anderson | 242/158 B |
| 3,583,653 | 6/1971 | Bliss | 242/158 B |
| 3,815,846 | 6/1974 | Biewer | 242/158 |
| 3,951,355 | 4/1976 | Morioka et al. | 242/158 |
| 4,022,391 | 5/1977 | Stein et al. | 242/25 |
| 4,148,445 | 4/1979 | Reynolds et al. | 242/86.5 |
| 4,150,801 | 4/1979 | Ikegami et al. | 242/158 |
| 4,428,540 | 1/1984 | Calcagno et al. | 242/158 F X |

FOREIGN PATENT DOCUMENTS

| | | | |
|---|---|---|---|
| 2322687 | 11/1973 | Fed. Rep. of Germany | 242/158 F |
| 896016 | 4/1944 | France | 242/158 R |
| 836411 | 6/1960 | United Kingdom | 242/158.4 R |
| 836412 | 6/1960 | United Kingdom | 242/158.4 R |
| 1194825 | 6/1970 | United Kingdom | 242/158 F |
| 2022636 | 12/1979 | United Kingdom | 242/158 R |

*Primary Examiner*—Stanley N. Gilreath
*Attorney, Agent, or Firm*—Kinney & Lange

[57] ABSTRACT

An apparatus guides a cable so that the cable is wound on a drum in a substantially uniform manner. The apparatus includes a support slidable attached to a longitudinal stationary guide tube mounted to a floor. The tube is positioned substantially parallel to the axis of the drum. A guide support member is slidably attached at one end to the support and has a longitudinal axis disposed substantially perpendicular to the axis of the drum. A first guide is positioned proximate a first end of the guide support and a second guide is positioned proximate a second end of the guide support. The first and second guides guide the cable along the longitudinal axis of the guide support. Power to move the guide support is provided by a hydraulic system to a hydraulic actuator that moves the guide support. The hydraulic actuator includes a hydraulic motor mounted on the guide support member and a sprocket drivably attached to the motor. The sprocket engages a stationary double link chain that extends parallel to the axis of the drum. A cable contact-valve actuating member is positioned on the guide support between the first guide and second guide contacting the cable on two sides. The actuating member is engaged by the cable as the cable is being wound on the drum, activating a valve which directs hydraulic fluid into the motor. The motor, in cooperation with the chain, moves the guide support such that the cable it wound on the drum in a substantially even manner.

12 Claims, 7 Drawing Figures

CABLE WINDING APPARATUS

REFERENCE TO CO-PENDING APPLICATION

This is a continuation-in-part application of application Ser. No. 516,803 filed on July 25, 1983, now U.S. Pat. No. 4,493,463.

BACKGROUND OF THE INVENTION

1. Field of the Invention

The present invention relates to cable winding apparatus, and in particular, it relates to apparatus for guiding the cable so that it is wound in a substantially uniform manner on a drum.

2. Description of the Prior Art

The winding of large diameter steel cables on a drum in a substantially uniform manner has been an old problem. Large diameter cables, such as a $\frac{5}{8}$ inch cable, are commonly used on winch drums in the mining industry to lift various loads, for example, to retrieve very large diameter cables such as a 4 inch cable, which may weigh several tons.

There have been several attempts, as described in prior art patents, to solve the problem of winding a cable onto a drum.

In the Wilson U.S. Pat. No. 2,660,382, a level winding device for winding a cable onto a drum is described. The device includes a guide head which is moved by an air motor in the direction of the winding of the cable onto the drum. The guide head moves in a direction substantially parallel to the drum along a number of guide rods and is moved along the guide rods by a chain and sprocket wheel combination. A valve admits air to the motor so that the guide head is moved along the rods by the chain. The movement of the guide head is activated by the transverse movement of the cable. However, the device of the Wilson patent is not sufficiently durable for long term usage with large diameter cable.

Dahlberg U.S. Pat. No. 601,827, the Heylman U.S. Pat. No. 708,979, the Shannon U.S. Pat. No. 1,000,203, the Adams et al U.S. Pat. No. 2,962,242 and the Ikegami et al. U.S. Pat. No. 4,150,801 disclose various mechanisms for winding a rope or wire onto spools or drums. However, none of the winding mechanisms in the immediately above-mentioned patents are capable of winding large diameter steel cables onto drums in a substantially uniform manner.

Other patents, such as the Taylor U.S. Pat. No. 1,763,871, the Biewer U.S. Pat. No. 3,815,846, the Morioka et al. U.S. Pat. No. 3,951,355, the Stein et al U.S. Pat. No. 4,022,391 and the Reynolds et al. U.S. Pat. No. 4,148,445 describe mechanisms for winding cable, pipe, rope and wire onto spools or drums wherein the cable, rope, pipe and wire directs the traversing of the guide so that a substantially even wind is obtained. However, due to the characteristics of braided steel cable, the immediately above-mentioned mechanisms would not satisfactorily wind steel cable on a drum or spool.

SUMMARY OF THE INVENTION

The present invention includes an apparatus for guiding a cable in a substantially uniform manner on a rotatable spool or drum. The apparatus includes a longitudinal stationary guide member fixedly attached to a floor. A guide support member slidably engages the stationary guide member proximate a first end, which is closest to the drum. A first guide is attached to the guide support member for guiding the cable and permitting the cable to move a limited distance in a transverse direction to the drum, that is, side to side in a direction along the axis of rotation of the drum. A second guide is positioned on the guide support member proximate a second end and is disposed in a substantially perpendicular relationship with respect to the first guide relative to the axis of the drum. The second guide engages the cable on two sides. A hydraulic system provides hydraulic fluid to a hydraulic motor having a sprocket. A stationary chain extends substantially parallel to the axis of the drum and is in cooperative engagement with the sprocket. A hydraulic valve selectively directs flow of hydraulic fluid from the hydraulic system to the hydraulic motor. An actuating mechanism is mounted on the guide support member between the first and second guides and engages the cable on two sides. The actuating mechanism is movable in a transverse direction and is connected to the valve such that any transverse movement of the cable is transmitted to the valve whereupon the flow of hydraulic fluid to the hydraulic motor is directed so that the sprocket moves along the chain moving the guide support member corresponding to the transverse movement of the cable.

DETAILED DESCRIPTION OF THE PREFERRED EMBODIMENTS

Figure 1:
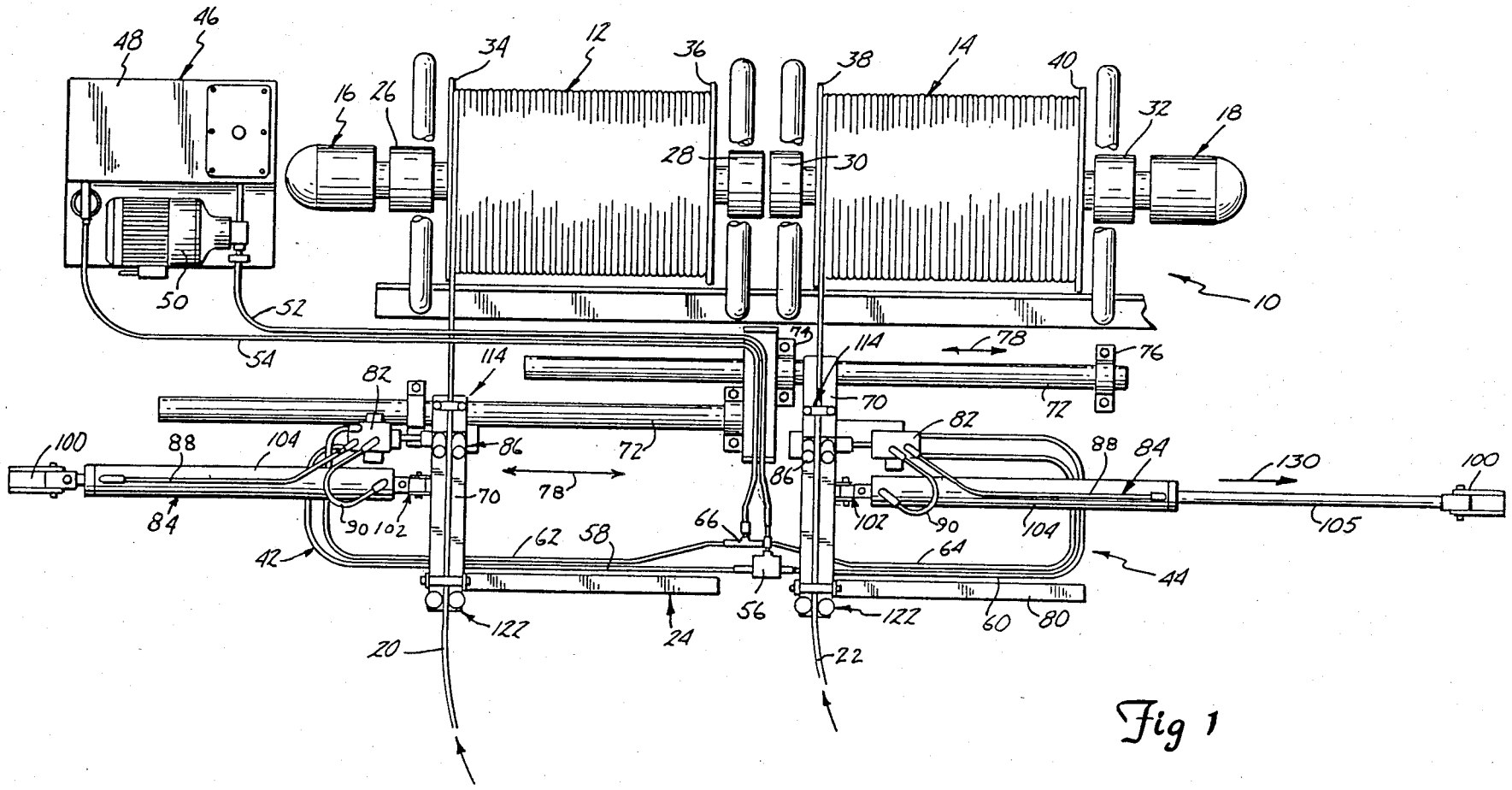
FIG. 1 is a top view of the guiding apparatus of the present invention.

A cable winding apparatus is generally indicated at 10 in FIG. 1. The cable winding apparatus shown in FIG. 1 includes two drums 12 and 14. The drums 12, 14 are driven independently of each other by suitable motors 16 and 18, respectively. The motors are shown schematically and generally in actual use will be operating through gear reducers. Cable 20 and 22 are wound on the drums 12 and 14, respectively, by a cable guiding apparatus generally indicated at 24. The cable guiding apparatus 24 of the present invention, has the capability of winding two cables on the individually driven drums 12 and 14 or a single cable on either drum.

Each of the drums 12 and 14 are rotatably mounted on rigid supports 26, 28, 30 and 32, respectively. The drum 12 has end plates 34 and 36 which define the area of the drum 12 on which the cable 20 is wound. Similarly, the spool or drum 14 has end plates 38 and 40 which also define the area on which the cable 22 is wound.

The cables 20 and 22 are a braided, relatively large diameter, steel cable. In one successful application, the present invention is used to wind $\frac{5}{8}$ inch diameter cable in a coal mine operation. The $\frac{5}{8}$ inch cable is used to retrieve 4 inch diameter cable. It is important that the $\frac{5}{8}$ inch cable is wound uniformly so that it is readily available for subsequent operation.

The cable is wound onto the drums 12 and 14 in a substantially uniform manner by the cable guiding apparatus 24. The cable guiding apparatus 24 as illustrated in FIG. 1, includes a left cable guiding mechanism 42 for guiding the cable 20 onto the drum 12 and a right cable guiding mechanism 44 for guiding the cable 22 onto the drum 14. Both the left and right cable guiding mechanism 42, 44 receive power from a common hydraulic system 46. The hydraulic system 46 includes a reservoir 48, a hydraulic pump 50, a supply conduit 52 conveying hydraulic fluid to and a return conduit 54 conveying hydraulic fluid from the guiding apparatus 24, respectively.

Fluid is diverted to the left and right cable guiding mechanisms 42 and 44 through a flow divider 56. The flow divider 56 diverts a portion of the hydraulic fluid to a conduit 58 to the left cable guiding mechanism 42 and to a conduit 60 to the right cable guiding mechanism 44. Hydraulic fluid flows back to the hydraulic system 46 through a conduit 62 from the left cable guiding mechanism 42 and through a conduit 64 from the right cable guiding mechanism 44. The conduits 62 and 64 are joined by a Tee 66 which is connected to the return conduit 54.

Figure 2:
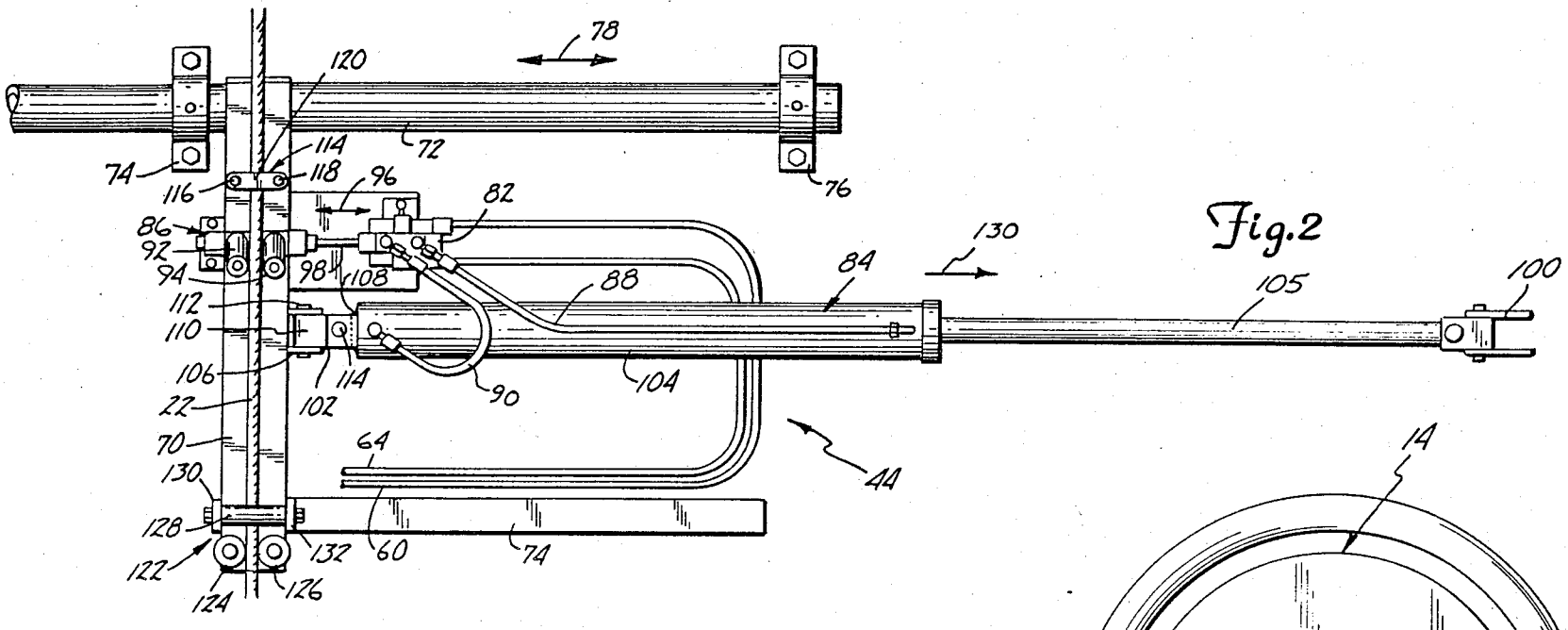
FIG. 2 is an enlarged top view of the right cable guiding mechanism on the right side of the drums.

The guiding mechanisms 42 and 44 are mirror images of each other and will be described with reference to right cable guiding mechanism 44 as illustrated in FIG. 2. It is to be understood that like reference characters will indicate like elements of both left and right cable guiding mechanisms 42 and 44 as illustrated in FIG. 1.

The right guiding mechanism 44 includes a guide support member 70 fixedly attached to an elongated track tube 72 such as by welding. The track tube 72 is preferably cylindrical in shape and is disposed substantially parallel to the axis of the drum 14, as illustrated in FIG. 1. The guide support member 70 is disposed substantially perpendicular to the axis of the drum 14.

A pair of brackets 74 and 76 having bearings are fixedly mounted to a floor or frame. The tube 72 extends through the brackets 74 and 76 and engages the bearings, permitting the guide tube to slide in opposite transverse directions, along its axis as indicated by arrow 78, substantially parallel to the axis of the drum 14.

The brackets 74 and 76 are spaced apart at least the distance of the end plates 38 and 40, as illustrated in FIG. 2, permitting the guide support member to travel the entire distance between the end plates. The brackets 74 and 76 and track tube 72 provide sufficient support during the winding operation to keep the guide support member 70 in a substantially perpendicular position to the axis of the drum 14.

Figure 3:
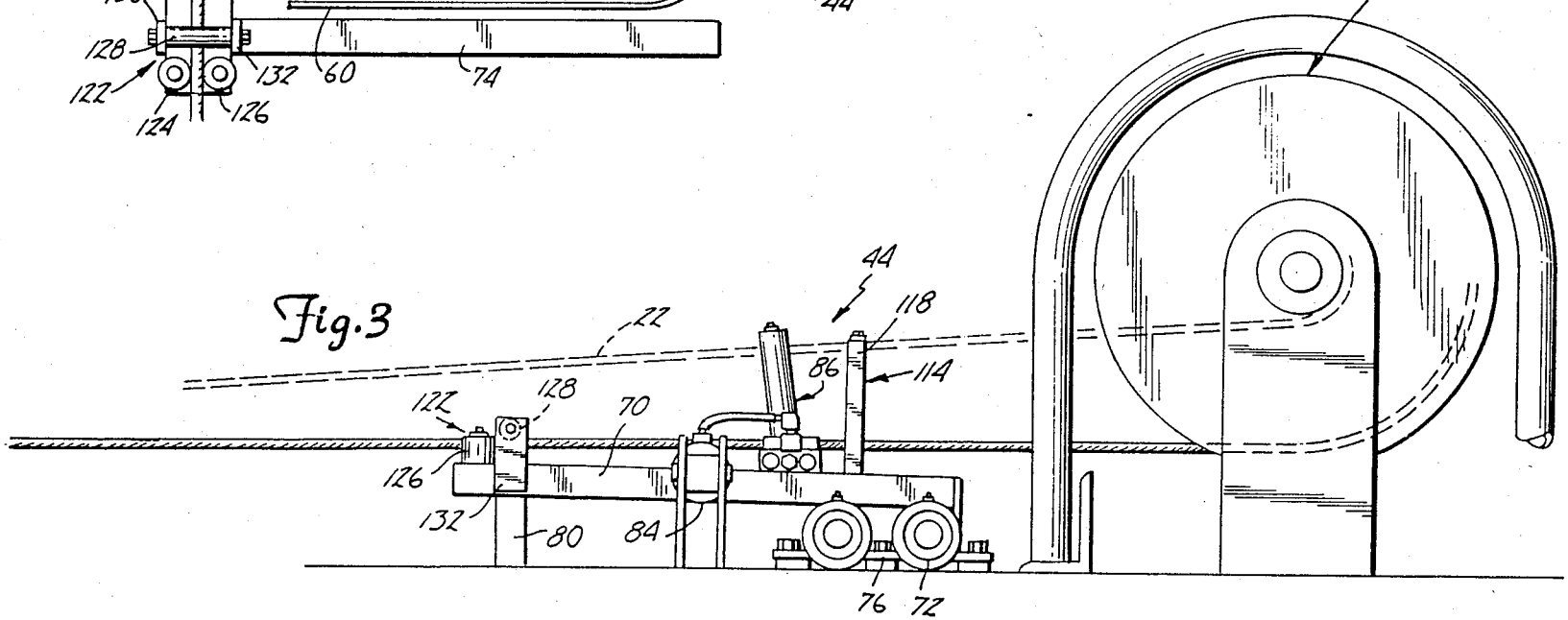
FIG. 3 is a side view of the right side cable guiding mechanism.

A support bar 80 is positioned below the support guide member 70 proximate an end of the member 70 away from the drum 14. The support bar 80 is fixedly attached to the floor and supports the end of the guide member 70, as illustrated in FIG. 3.

The right guiding mechanism further includes a hydraulic valve 82, a double-acting hydraulic actuator 84 and a cable contact-valve actuating member 86. The conduit 60 supplies hydraulic fluid under pressure to the hydraulic valve 82. The hydraulic valve 82 is a standard type of valve and is fluidly connected to the actuator 84 on opposite sides of an internal piston by conduits 88 and 90. The conduit 88 supplies hydraulic fluid to one side of the piston of actuator 84 and the conduit 90 supplies fluid to the other side of the piston of actuator 84. Hydraulic fluid is supplied under pressure either to line 88 or 90 and flows from the actuator 84 through either conduit 88 or 90, depending on the position of the valve.

The cable contact-valve actuating member 86 is slidably positioned on the support guide member 70 as indicated by arrow 96 and has a pair of upright contact rollers 92 and 94 between which the cable 22 rides. The rollers are spaced to fit closely against the cable so that any transverse movement of the cable will move the member 86. A connecting rod 98 connects the cable contact-valve actuating member 86 with an internal flow control spool of the valve 82. The rod 98 is also movable in the direction of arrow 96 as controlled by lateral movement of the cable as it actuates the cable contact-valve actuating member 86 and places the valve in a state that either conveys hydraulic fluid under pressure in either conduit 90 or 88 and permits flow from the actuator 84 through either conduit 90 or 88.

The hydraulic actuator 84 is a standard double-acting actuator having a cylinder housing 104 and a piston rod 105. The actuator 84 has a stroke length sufficiently long to move the guide support member 70 from one end plate 38 to the other end plate 40. The piston rod 105 is pivotally connected to a bracket 100 at one end that is secured to the floor. At the other end of the actuator 84, a pivotal connector 102 pivotally connects an end of the housing 104 to the guide support member 70. The pivotal connector 102 is a universal-type connector having an end 106 fixedly attached, such as by welding, to the guide support member 70 and another end 108 preferably being an integral part of the housing 104. A middle section 110 is attached to the end 106 by a pivot pin 112 and to the end 108 by a pivot pin 114. As will be easily understood by those skilled in the art, actuator 84 is securely and flexibly attached to the guide support member 70.

A cable guide 114 is securely attached on a top surface of the control guide member 70 proximate an end closest to the drum 14, as best illustrated in FIGS. 2 and 3. The guide 114 includes a pair of substantially upright rollers 116 and 118 rotatably attached to the guide support member 70 at their bottom ends and rotatably attached to a connecting member 120 at their top ends. The rollers 116 and 118 are spaced apart sufficiently to permit the cable to move in the transverse direction a limited distance between these guides while the cable is being wound. The connecting member 120 insures that the cable 22 stays between the rollers 116 and 118.

A second guide 122 is positioned on the guide support member 70 proximate the end farthest from the drum 14, as illustrated in FIGS. 2 and 3, and on the opposite side of cable control valve actuating member 86 from guide 114. Preferably, the guide 122 includes a pair of substantially upright rollers 124 and 126 spaced from each other a distance approximately equal to the diameter of the cable 22. A third substantially horizontal roller 128 is positioned on a side of the upright rollers 124 and 126 that is closest to the drum 14. The substantially horizontal roller 128 is rotatably attached to a pair of substantially upright tab members 130 and 132 that are securely attached to the guide support member 70, such as by welding. Preferably, the substantially horizontal roller 128 is positioned above the uppermost end of the upright rollers 124 and 126, as illustrated in FIG. 3.

The guides 114 and 122 define respective openings through which the cable extends. The cable also extends through the cable contact-valve actuating member 86. The openings and the distance between the openings define a cable path along which the cable travels before being wound on the drum 14. The substantially upright rollers 124 and 126 of the guide 122 engage the cable 22 between each other on two sides and define a fixed point in the transverse direction along the cable path. As the cable is wound onto the drum 14, the cable positions itself adjacent to a previous wrap of cable on the drum and moves in a transverse direction between the rollers 116 and 118 of the guide 114, while being held in a fixed transverse position by the guide 122. The rollers 116 and 118 are spaced so the cable length extending between guides 114 and 122 moves in a transverse direction sufficiently to move the cable contact-valve actuating member 86. The member 86, through connecting rod 98, actuates the valve 82, allowing hydraulic fluid to enter the actuator 84 on one side of the internal piston and to exit on the other side of the piston. The actuator lengthens or shortens to move the guide support member 70 in the proper transverse direction, guiding the cable onto the drum in even layers.

At the start of an operation, the cable 22 generally lies in a substantially perpendicular position to the axis of the drum 14. For purposes of an example, at the beginning of a winding operation, the cable is started near the end plate 38, as illustrated in FIG. 1. After the drum has completed a revolution and a length of the cable has been wound next to the end plate 38, the next length of cable to be wound will position itself next to the first length of cable. When the next length of cable positions itself adjacent to the previous cable, the section of cable in the guide support member moves transversely to the right. The cable moves the cable contact-valve actuator member 86 to the right, actuating the valve 82 which allows hydraulic fluid to flow under pressure through conduit 90, and permits hydraulic fluid to flow out of the actuator 84 through conduit 88, moving the actuator in a direction of arrow 130 in a follow-up action until the valve 82 reaches a neutral position.

As the cable is wound further along the drum, successive winds of the cable will be positioned against each other and keep the member 86 positioned to the right, permitting more fluid to flow into the actuator through conduit 90 and more hydraulic fluid to escape through conduit 88, further moving the actuator in the direction of arrow 130. The actuator moves the support guide member 70 further to the right allowing the cable to wind substantially uniformly on the drum as a follow-up system that reaches a neutral position when the cable contact-valve actuating member returns to a central position.

As should be understood from the above description, when the cable reaches the end plate 40, as shown in FIG. 1, the next wind of cable will position itself on the drum to the left of the wind of cable next to the end plate 40. The cable contact-valve actuating member 86 is then moved by the cable to the left, reversing the flow of fluid into the hydraulic actuator. Reversing the flow of fluid move the actuator in a direction opposite to the arrow 130 thereby moving the guide support member 70 to the left permitting cable to be wound to the left on the drum 14 in a substantially even manner as the actuator follows up the cable movement.

The support guide member travels back and forth between the end plate 38 and 40 of the drum 14 in a similar manner to that described above until all the cable is wound onto the drum 14.

Hydraulic fluid under pressure is supplied by conduit 52 to both the left guiding mechanism and the right guiding mechanism, permitting both left and right guide mechanisms 42 and 44 to act independently of each other. The cable is wound onto the drum 12 in a similar manner as was described with reference to the right guiding mechanism 44 and drum 14. It should be understood that the present invention is not limited to two drums being wound. A single drum or a number of drums may be wound using the present invention. However, more than one drum is preferred since only one hydraulic system 46 is needed for a plurality of winding mechanisms, making the present invention desirable in terms of cost.

An alternative embodiment generally indicated at 150 is illustrated in FIGS. 4–7. The embodiment 150 includes a longitudinal tube 152, mounted to the floor (or a base 157 as illustrated only in FIG. 6) by brackets 154 and 156 proximate first and second ends 158 and 160, and disposed substantially parallel to the axis of the drum.

A guide support member 162 is disposed substantially perpendicular to the axis of the drum, similarly to the guide support member 70, as discussed with reference to FIGS. 1–3. The guide support member includes a bearing sleeve 164 fixedly attached to a longitudinal supporting plate 166 that is disposed perpendicularly to the axis of the drum. The bearing sleeve 164 slidably engages the circumference of the tube 152 such that the guide support 162 easily slides along the length of the tube 152.

Similar to the embodiment discussed with reference to FIGS. 1–3, the embodiment 150 also includes a first cable guide 168 and a second cable guide 170, similar to the cable guides 114 and 122. An actuating member 172, similar to the actuating member 86 in FIGS. 1–3, is movable in a direction transverse to the winding of the cable such that any transverse movement of the cable will move the actuating member 172.

Figure 4:
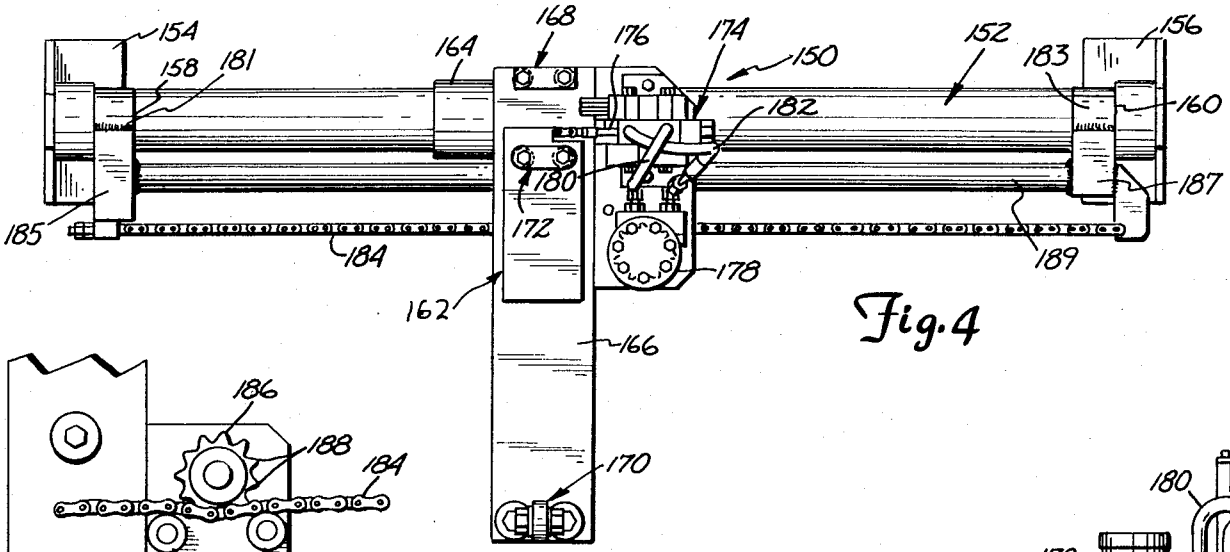
FIG. 4 is a top view of an alternative embodiment of the present invention.
Figure 6:
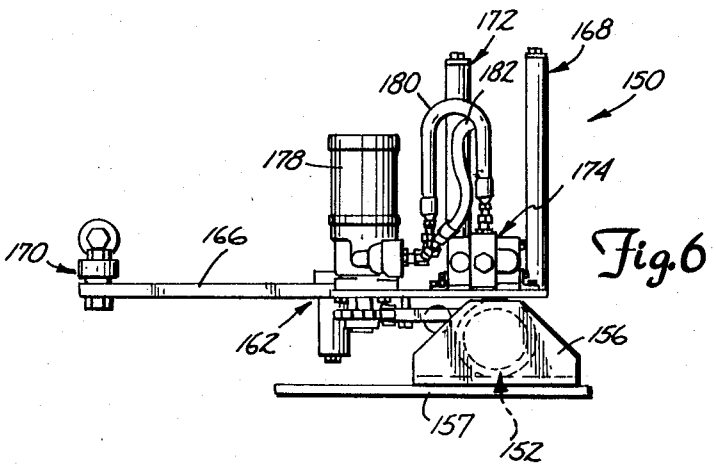
FIG. 6 is a side view of the alternative embodiment of FIG. 4.

The actuating member 172 is connected to a hydraulic valve 174 connecting rod 176, as illustrated in FIG. 4. A hydraulic motor 178 is fluidly connected to the valve 174 by conduit 180 and 182 such that the motor 178 can be operated selectively in one direction and then another depending on whether the flow of hydraulic fluid is through conduit 180 or 182.

A double link-type chain 184 is attached to the tube 152 by a pair of sleeves 181 and 183 proximate ends 158 and 160, respectively. The sleeves 181 and 183 rotatably engage the tube 152 and have tab portions 185 and 187 that extend outwardly, spacing the chain 184 from the tube 152. A reinforcing tube 189 is disposed between and attached to the tab portions 185 and 187 between the chain 184 and the tube 152. Since the sleeves 181 and 183 are rotatable with respect to the tube 152, the chain 184 which is attached to the ends of the tab portions 185 and 187 is movable angularly with respect to the axis of the tube 152 along with guide support member 162.

Figure 7:
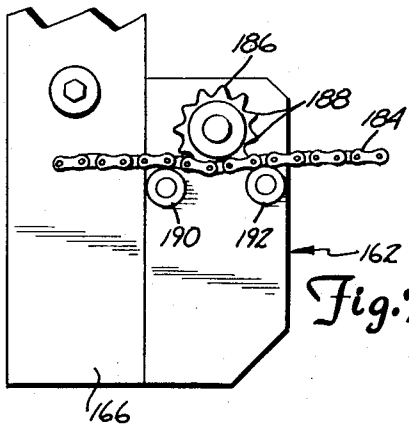
FIG. 7 is a bottom view of a sprocket and chain arrangement of the embodiment of FIG. 4.
Figure 5:
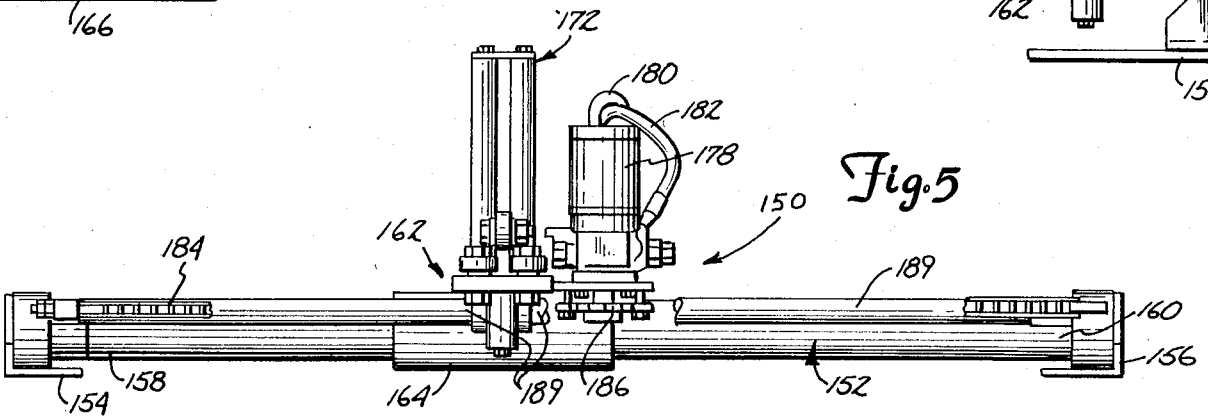
FIG. 5 is a front view of the alternative embodiment of FIG. 4.

The chain 184 extends preferably at least the width of the drum and is disposed substantially parallel to the axis of the drum. As best illustrated in FIG. 7, a sprocket 186 is drivably connected to the hydraulic motor 178 and has a plurality of sprocket teeth 188 for engagement with the links of the chain 184. First and second rollers 190 and 192 are rotatably attached to the bottom side of the guide support 162, as the sprocket 188 and the chain 184, and are positioned on opposite sides of the sprocket 186 to ensure that the sprocket teeth 188 engage the chain 184.

In operation, as a cable is being wound on the drum and guided by the cable guides 170 and 168 and moves transversely with respect to the direction of wind, the cable engages the actuator 172. The actuator 172 actuates the valve 174 and introduces flow of hydraulic fluid into the motor 178 through either conduit 180 or 182. The motor 178 in turn turns the sprocket in a corresponding direction and the sprocket engages the chain moving the guide support member to position the cable so that successive winds of the cable will be positioned against each other on the drum.

A plurality of winding mechanisms illustrated in FIGS. 4 through 7 are provided for each corresponding drum, as discussed with reference to the embodiment in FIG. 1, and provided with hydraulic fluid from one hydraulic system. With one hydraulic system providing hydraulic fluid, the alternative embodiment is also desirable in terms of cost.

In summary, the present invention solves an old problem of winding steel cable substantially evenly on a drum in an economic and efficient manner. The present invention permits multiple drums to be wound with cable using only one hydraulic system.

Although the present invention has been described with reference to preferred embodiments, workers skilled in the art will recognize that changes may be made in form and detail without departing from the spirit and scope of the invention.

What is claimed is:

1. An apparatus for guiding a cable in a substantially uniform manner on a rotatable drum, the apparatus being mounted on a base proximate the drum and the drum having a central axis and first and second spaced apart ends, the apparatus comprising:

a longitudinal stationary guide mounted to the base substantially parallel to the axis of the drum;

a guide support member having first and second ends, the first end being disposed closer to such drum than the second end and the guide support member being slidably attached to the longitudinal guide for travel substantially parallel to the axis of the drum;

first guide means for guiding a cable controlled by such drum, the first guide means being attached to the guide support member proximate the first end and being configured to permit the cable to move a limited distance in the transverse direction;

second guide means for guiding the cable, the second guide means being positioned on the guide support member proximate the second end in a substantially perpendicular relationship with the first guide means relative to the axis of such drum, the second guide means slidably engaging the cable on two sides;

hydraulic power means for providing hydraulic fluid;

actuator means fluidly connected to the hydraulic power means for moving the guide support member along the longitudinal guide including a hydraulic motor operably connected to the valve means and mounted on the guide support member and selectively operable in a first and second direction and further including a sprocket drivably connected to the hydraulic motor and a stationary chain extending the width of the drum and the sprocket engaging the chain;

hydraulic valve means for directing the flow of hydraulic fluid from the power means to the actuator means; and cable controlled means for actuating the hydraulic valve means movably mounted on the guide support member and normally engaging the cable extending from such drum, the cable controlled means for actuating being operably connected to the hydraulic valve means such that transverse movement of the cable moves the cable controlled means for actuating and activates the hydraulic valve means to direct flow to the actuator means so that the actuator means moves the guide support member in either a first or second transverse direction corresponding to the transverse movement of the cable by the sprocket engaging the chain.

2. The apparatus of claim 1 wherein the first guide means includes a pair of spaced-apart substantially upright first guide rollers.

3. The apparatus of claim 1 wherein the second guide means includes a pair of spaced-apart substantially upright second guide rollers engaging the cable on two sides.

4. The apparatus of claim 3 wherein the second guide means further includes a substantially horizontal roller rotatably mounted on the guide support member proximate the second guide rollers and disposed to retain the cable between the second guide rollers.

5. The apparatus of claim 1 wherein the means for actuating the hydraulic valve means includes a pair of rotatably mounted transversely movable spaced-apart rollers normally engaging the cable on two sides.

6. The apparatus of claim 5 wherein the cable controlled means for actuating further includes a connecting member having first and second ends with the first end being attached to the transversely movable rollers and the second end being attached to the valve means so that the transverse movement of the rollers activates the valve means to direct the flow of hydraulic fluid to the actuator means.

7. An apparatus for guiding first and second cables in a substantially uniform manner on first and second rotatable drums, respectively, the apparatus being mounted on a base proximate the drums and each of the drums having a central axis and first and second spaced apart ends, the apparatus comprising:

first and second longitudinal stationary guides mounted to the base substantially parallel to the axis of the drum;

first and second guide support members, each support member having first and second ends, the first end being disposed closer to the corresponding drum than the second end, the first and second guide support members being slidably attached to the first and second longitudinal stationary guides, respectively;

first guide means for guiding the cable on each guide support member, the first guide means being attached to the respective guide support member proximate the first end and having means for permitting the corresponding cable to move a limited distance in the transverse direction;

second guide means for guiding the cable on each guide support member, the second guide means being positioned on the respective guide support member proximate the second end in a substantially perpendicular relationship with the first guide means relative to the axis of the corresponding drum, the second guide means slidably engaging the corresponding cable on two sides;

hydraulic power means for providing hydraulic fluid;

first and second actuator means fluidly connected to the hydraulic power means for moving the first and second guide support members, respectively, each actuator means including a hydraulic motor operably connected to the valve means and mounted on the guide support member and selectively operable in a first and second direction and further including a sprocket drivably connected to the hydraulic motor and a stationary chain extending the width of the drum and the sprocket engaging the chain;

first and second hydraulic valve means for directing the flow of hydraulic fluid from the power means to a respective actuator means;

flow diverter means for diverting flow from the power means to the first and second valve means; and cable controlled means for actuating the hydraulic valve means movably mounted on each guide support member and normally engaging the corresponding cable on two sides, the cable controlled means for actuating being operably connected to the respective hydraulic valve means such that transverse movement of the corresponding cable moves the cable controlled means for actuating and activates the respective hydraulic valve means to direct flow to the corresponding actuator means so that each actuator means moves the respective guide support member in either a first or a second transverse direction corresponding to the transverse movement of each cable independently of the other cable, said guide support members being moved by the sprocket engaging the chain.

8. The apparatus of claim 7 wherein the first guide means includes a pair of first guide spaced-apart substantially upright rollers.

9. The apparatus of claim 7 wherein the second guide means includes a pair of spaced-apart substantially upright second guide rollers engaging the cable on two sides.

10. The apparatus of claim 9 wherein the second guide means further includes a substantially horizontal roller rotatably mounted on the respective guide support member proximate the second guide rollers and disposed to retain the corresponding cable between the second guide rollers.

11. The apparatus of claim 7 wherein the means for actuating the hydraulic valve means includes a pair of rotatably mounted transversely movable spaced-apart rollers normally engaging the corresponding cable on two sides.

12. The apparatus of claim 11 wherein each cable controlled means for actuating further includes a connecting member having first and second ends with the first end being attached to the transversely movable rollers and the second end being attached to the valve means so that the transverse movement of the rollers activates the valve means to direct the flow of hydraulic fluid to the actuator means.

* * * * *